US008041262B2

(12) United States Patent
Carter et al.

(10) Patent No.: US 8,041,262 B2
(45) Date of Patent: Oct. 18, 2011

(54) DRIVE SYSTEM WITH MULTIPLE MOTOR-AND-GEAR-TRAIN CONFIGURATIONS FOR JITTER AND NOISE REDUCTION AND COLOR DEVELOPER PRESERVATION

(75) Inventors: Daniel L. Carter, Georgetown, KY (US); Brian Reed Spencer, Lexington, KY (US); Larry Steven Foster, Lexington, KY (US); Lowell Thomas Siders, Nicholasville, KY (US); Edward Lynn Triplett, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 543 days.

(21) Appl. No.: 12/022,231

(22) Filed: Jan. 30, 2008

(65) Prior Publication Data

US 2009/0190956 A1 Jul. 30, 2009

(51) Int. Cl.
*G03G 15/00* (2006.01)

(52) U.S. Cl. ..... 399/167

(58) Field of Classification Search ..... 399/167, 399/223; 476/28, 31
See application file for complete search history.

(56) References Cited

U.S. PATENT DOCUMENTS 4,796,050 A * 1/1989 Furuta et al. ..... 399/167
5,319,418 A * 6/1994 Fujimoto et al. ..... 399/167
6,473,580 B1 * 10/2002 Inomata ..... 399/167
7,366,445 B2 * 4/2008 Hoashi et al. ..... 399/167
7,672,614 B2 * 3/2010 Kang et al. ..... 399/167
2003/0170048 A1 * 9/2003 Ahn ..... 399/167
2005/0025523 A1 * 2/2005 Iwasaki et al. ..... 399/167
2005/0141921 A1 * 6/2005 Baek ..... 399/167
2005/0286932 A1 * 12/2005 Kim et al. ..... 399/167
2005/0286933 A1 * 12/2005 Kim et al. ..... 399/167
2006/0153592 A1 * 7/2006 Shimura et al. ..... 399/167
2007/0201902 A1 * 8/2007 Murayama ..... 399/167
2007/0231007 A1 * 10/2007 Arakawa ..... 399/167

* cited by examiner

*Primary Examiner* — Kiho Kim

(57) ABSTRACT

A color electrophotographic printing machine has a drive system which includes a first, second and third motor-and-gear-train configurations mounted on a frame and coupled to first, second and third combinations of multiple color developer drive assemblies, multiple color photoconductive drum drive assemblies, a black developer drive assembly and a black photoconductive drum drive assembly. The first and second configurations are operable at first and second motor gear mesh frequencies and the third configuration is operable at a motor gear mesh frequency that can be substantially the same as one of the first and second motor gear mesh frequencies. The first combination includes yellow, cyan and magenta color developer drive assemblies, the second includes yellow and cyan color photoconductive drum drive assemblies, and the third includes a magenta color photoconductive drum drive assembly with the black developer drive assemblies and black photoconductive drum drive assemblies.

20 Claims, 4 Drawing Sheets

DRIVE SYSTEM WITH MULTIPLE MOTOR-AND-GEAR-TRAIN CONFIGURATIONS FOR JITTER AND NOISE REDUCTION AND COLOR DEVELOPER PRESERVATION

CROSS REFERENCES TO RELATED APPLICATIONS

None.

STATEMENT REGARDING FEDERALLY SPONSORED RESEARCH OR DEVELOPMENT

None.

REFERENCE TO SEQUENCE LISTING, ETC.

None.

BACKGROUND

1. Field of the Invention

The present invention relates generally to drive system configuration and operation in electrophotographic (EP) printing machines, and, more particularly, to a drive system with multiple motor-and-gear-train configurations for reduction of jitter and noise and shutoff of color developer drive assemblies during black only mode operation for preservation of color developer useful life in the EP printing machine.

2. Description of the Related Art

Through a variety of mechanisms, engaged or meshed mechanical gears, or gears and pinions, generate vibration, or jitter, and noise while running. While gears meshing under load will generate some noise, the level of noise is exacerbated when the gears are subjected to unsteady and/or unbalanced forces. Tooth-to-tooth spacing errors, gear teeth elasticity, and intentional and unintentional deviations of tooth running surfaces from ideal configurations, generate unsteady forces and motion that results in vibration and noise. Such noise and vibration sources may be found in a wide variety of gear types, including spur, helical, worm and bevel type gears. By way of definition, gear mesh frequencies come from the individual impacts of gear teeth against each other, and the gear mesh frequency is equal to the number of teeth on the gear times the gear (or rotor) speeds, in revolutions per minute (rpm). In other words, mesh frequency is the rate at which gear teeth pairs contact as they pass through mesh, expressed in Hz.

The vibration (and noise) spectra generated by meshed and running gears is primarily tonal in nature. There are strong tones corresponding to the gear mesh frequency and harmonics thereof. In addition, there are tones corresponding to the rotation rate of each gear, and harmonics thereof. Gear mesh tonal noise is different from and in addition to tonal noise that appears at frequencies related to the passage of armature slots within the motors, or related to harmonics of line frequency if an SCR drive is used. Furthermore, gear mesh noise is present regardless of the type of prime mover or drive mechanism.

Vibration, or jitter, and noise normally accompany satisfactory operation of many machines utilizing motors and gear trains for transmitting motion. Electrophotographic (EP) printing machines are no exception. It is a characteristic of EP printing machines that they typically involve repetitive starts and stops in the normal course of their operations such that engaging and meshing of gears over the operating life of the EP machine gradually and inevitably contribute to a normal expected level of gear wear, vibration or jitter and noise.

Unfortunately a further characteristic of EP printing machines also contributes to gear wear, vibration or jitter and noise over and above this expected level. This characteristic is that it is the inherent nature of EP printing machines that many of their major functional components are consumables and thus must be replaced by new ones after differing periods of usage over the operating lifetimes of the machines. These consumable components include toner cartridges, developer units, photoconductive (PC) drum units, fuser units and the like. (The PC drum unit and toner cartridge are typically a two-piece consumable component where the toner cartridge fits into the PC drum unit; then they slide together into the machine. These two consumables typically have different periods of usage with the PC drum being the longer of the two.) Each consumable component has gear(s) which mesh with corresponding gears of the drive train in the machine. The drive train components, however, are usually not part of the consumable items and so remain with the machine while the consumable components are replaced, some many times during the operating life of the machine. These non-replaced drive train components will inherently undergo wear over time and so each time a new consumable component is installed in the machine an old, worn gear of the drive train must interact and mesh with a new, non-worn gear of the replacement components. Sub-optimal gear engagements will frequently result due to even small losses of control over gear center distances and imposition of unbalancing forces as a result of these interactions and also from the repeated separating and re-engaging of gears in the recurring making and breaking of the drive train couplings with the consumable components. Thus, further increased vibration, or jitter, and noise may occur above the normal expected levels.

One approach to addressing the problem of gear mesh vibration and noise is disclosed in U.S. Pat. No. 5,809,843 to Barger et al. This patent proposes to cancel gear vibration and noise at gear meshing frequencies by imposing a canceling drive torque or force on a driven gear set. To accomplish this, sensors are located proximate to meshing gears to receive information representative of vibration and noise generated at the meshing gears. The noise information received is provided to a control mechanism that processes the noise information to generate a corresponding drive torque. The drive torque so generated corresponding to the noise information is applied to a drive shaft to reduce vibration and noise of the gear assembly at gear meshing frequencies. The drive torque applied to the drive shaft is thought to constitute an appropriate corrective torque and/or linear force to impose on a gear/shaft combination to effect a displacement at the gear tooth meshing interface so as to cancel the effects of imperfections including those attributable to gear tooth spacing, tooth shape, or the like. The corrective torque or force is imposed with an appropriate frequency content, amplitude and phase that result in desired noise and/or vibration reduction at points of interest. Thus, the approach of Barger et al. is primarily one of gear mesh vibration and noise generated feedback and cancellation at gear meshing frequencies.

While the approach of Barger et al. may be satisfactory in use for the specific applications for which it was designed, for example, electric motors, gas turbine systems, diesel generators, internal combustion engines or the like, it does not seem to be an appropriate approach calculated to provide a practical solution to the problem of vibration, or jitter, and noise as generated in EP printing machines. It would likely cost too much to try to implement and be highly unlikely to function satisfactorily in the start and stop operational environment of an EP printing machine. It appears to constitute a solution that is intended to operate at a level of precision that is not likely to be achievable or necessary in the EP printing machine operating environment.

Thus, there is still a need for an innovation that will overcome the above mentioned problem of machine gear mesh vibration, or jitter, and noise in a cost-effective manner.

SUMMARY OF THE INVENTION

The present invention meets this need by providing an innovation that is tailored in its practicality and cost to the particular mechanical operating environment of the EP printing machine. The approach underlying this innovation is to address the problem of vibration, or jitter, and noise by separating or spreading the torque across more motor power sources, particularly across three motors rather than two, instead of attempting to cancel vibration, or jitter, and noise by production and application of a corrective torque. This approach is a more cost-effective one in that its implementation has been accomplished in a way that has many added benefits besides just reducing the original problem of jitter and noise. Most of these benefits are realized in more cost effective maintenance in terms of promotion of longer life for developers, reduction in the number of replaceable components, and lower cost to provide thermal cooling ducts and run wire harnesses to all drive motors confined to one location.

Accordingly, in one aspect of the present invention, an EP printing machine drive system is provided having first, second and third motor-and-gear-train configurations respectively drivingly coupled to first, second and third combinations of developer drive assemblies and photoconductive drum drive assemblies s so as to operate the same and in which the first motor-and-gear-train configuration is operable at a first motor gear mesh frequency whereas the second motor-and-gear-train configuration is operable at a second motor gear mesh frequency different from the first gear mesh frequency such that the frequency peaks are lower than heretofore and are not additive and thus the problem of vibration, or jitter, and noise are reduced and the print quality is enhanced.

In another aspect of the present invention, the first, second and third motor-and-gear-train configurations of the drive system, in their respective drivingly coupled relationships with the first, second and third combinations, separate operation of color developer drive assemblies from operation of color photoconductive drum drive assemblies such that the first combination is multiple color developer drive assemblies, the second combination is multiple color photoconductive drum drive assemblies and the third combination is one color photoconductive drum drive assembly together with the black developer drive assemblies and black photoconductive drum assemblies such that prolongation of the useful life of color developer drive assemblies is promoted.

In a further aspect of the present invention, the first, second and third motor-and-gear-train configurations of the drive system are mounted on a frame at a common location with drive motors for other functional components of the machine which facilitates initial installation on the frame and maintenance thereafter at lower cost due to separation of the drive motors from replaceable consumable components of the machine.

BRIEF DESCRIPTION OF THE DRAWINGS

Figure 1:
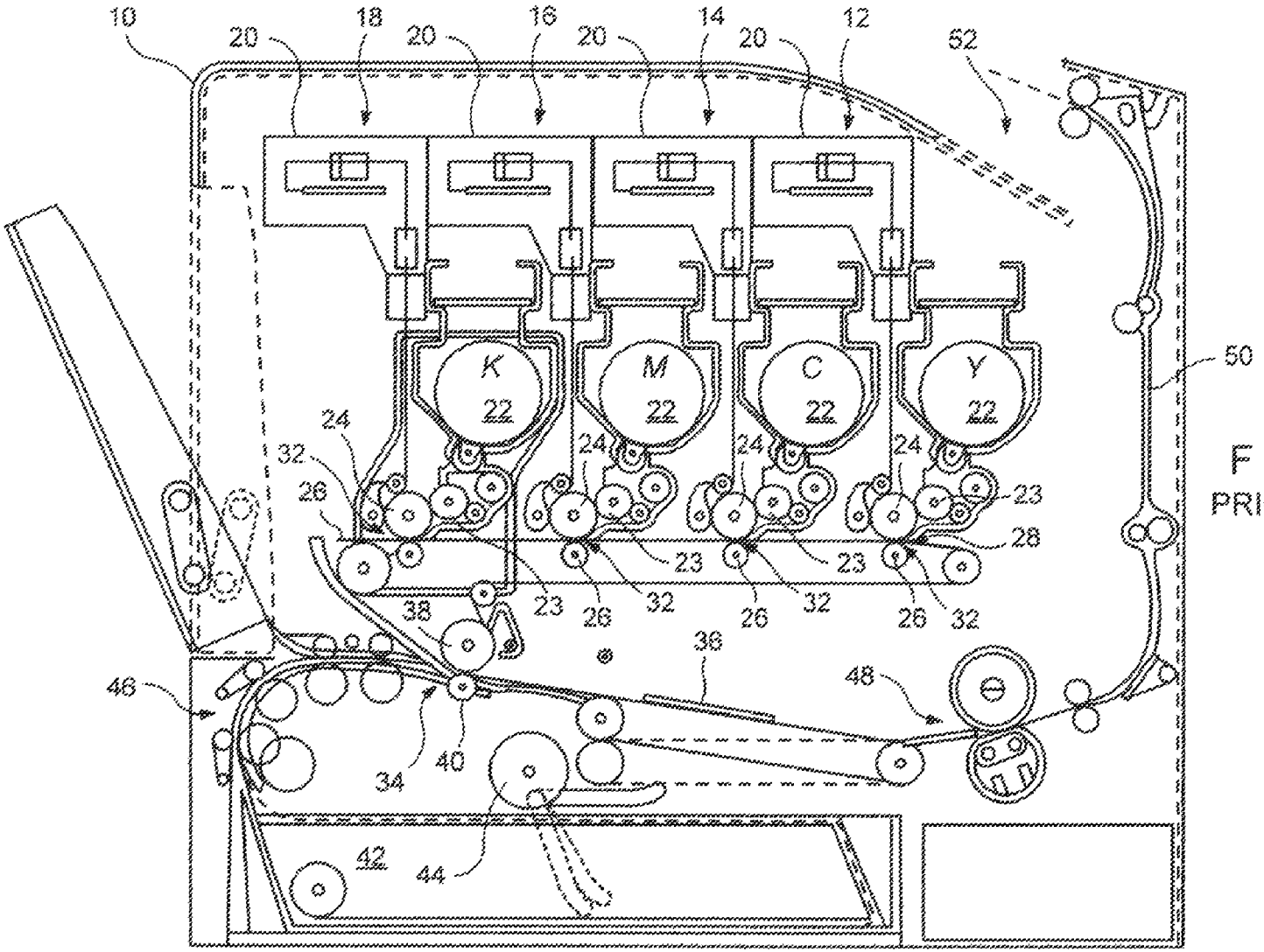
FIG. 1 PRIOR ART

Having thus described the invention in general terms, reference will now be made to the accompanying drawings, which are not necessarily drawn to scale, and wherein:

FIG. 1 is a schematic illustration of one general type of prior art electrophotographic (EP) printing machine in which the present invention may be employed.

Figure 2:
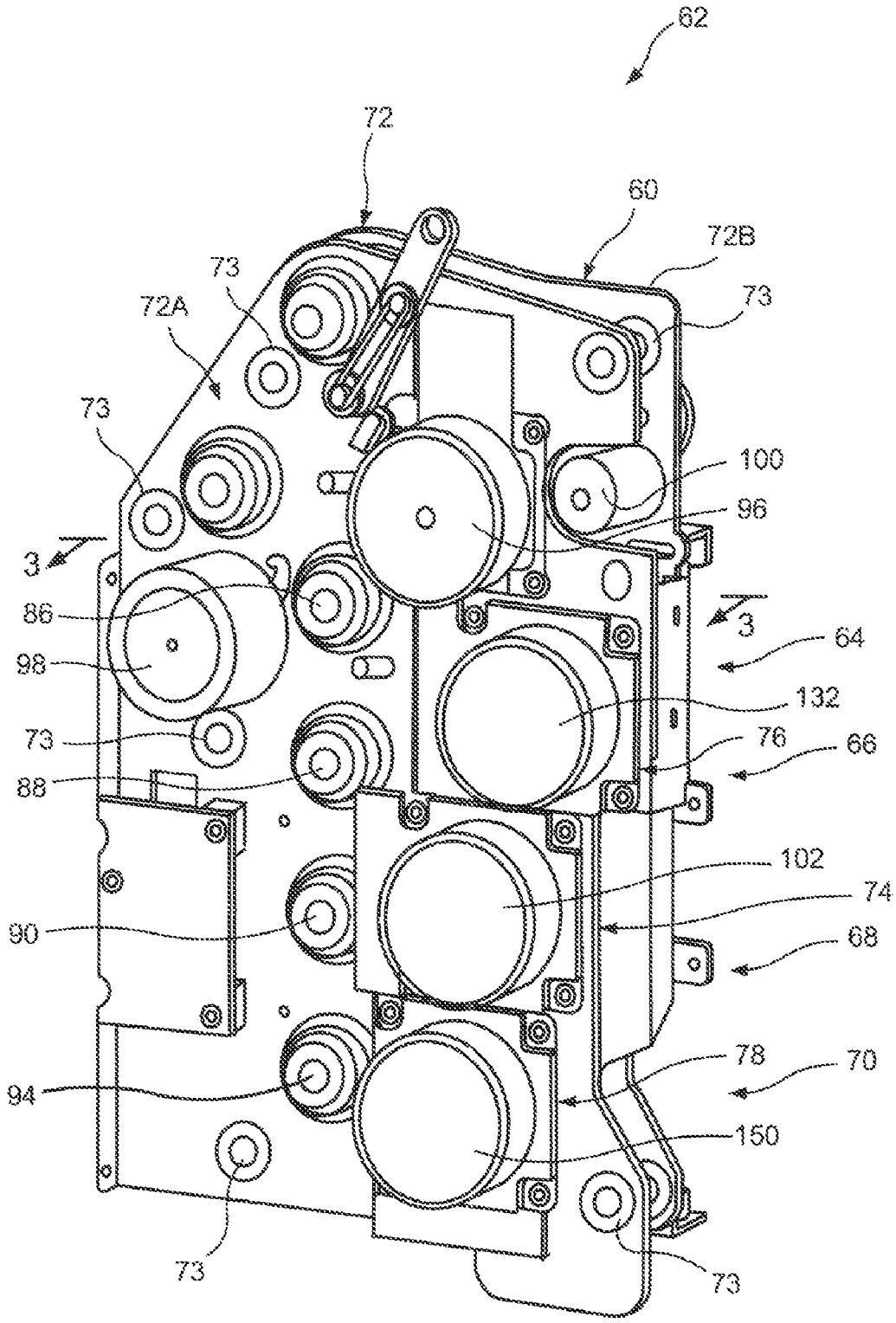

FIG. 2 is a perspective elevational view of an outer side of a frame subassembly of an EP printing machine showing supported on an outer mounting plate of the frame subassembly a plurality of drive motors of the multiple motor-and-gear-train configurations of the drive system of the present invention, one end of the fuser motor, drive motors for the fuser and belt transport and retraction, and mounting bases for one of the ends of the color and black photoconductive drum drive assembles.

Figure 3:
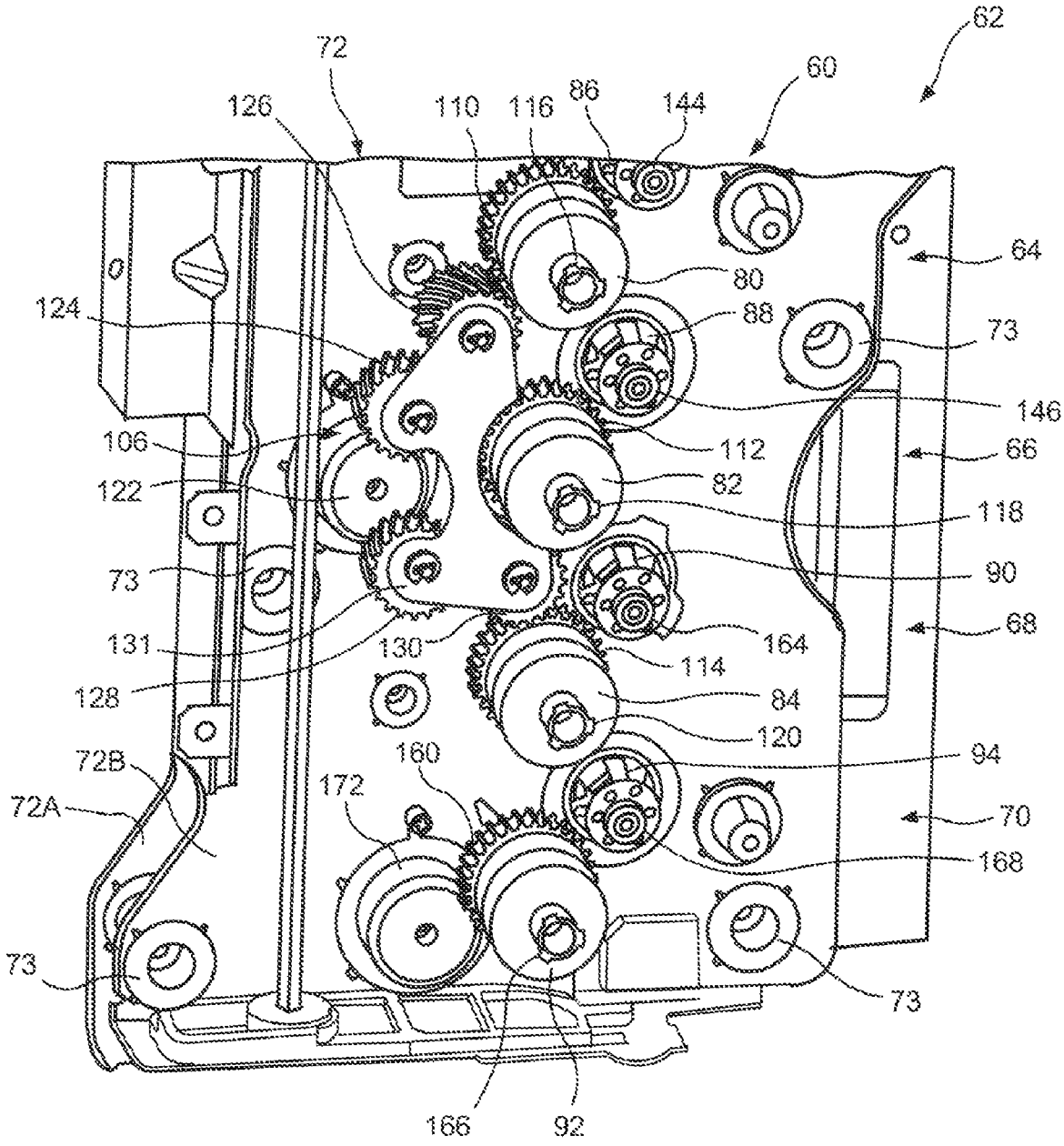

FIG. 3 is a fragmentary perspective elevational view of an opposite inner side of the frame subassembly of the machine, on an enlarged scale over that of FIG. 2 and below line 3-3 of FIG. 2, showing supported on an inner mounting plate of the frame subassembly some of the plurality of gears of the multiple motor-and-gear-train configurations of the drive system of the present invention, one end of the color and black developers, and also the same mounting bases for the one of the ends of the color and black photoconductive drum drive assemblies as shown in FIG. 2.

Figure 4:
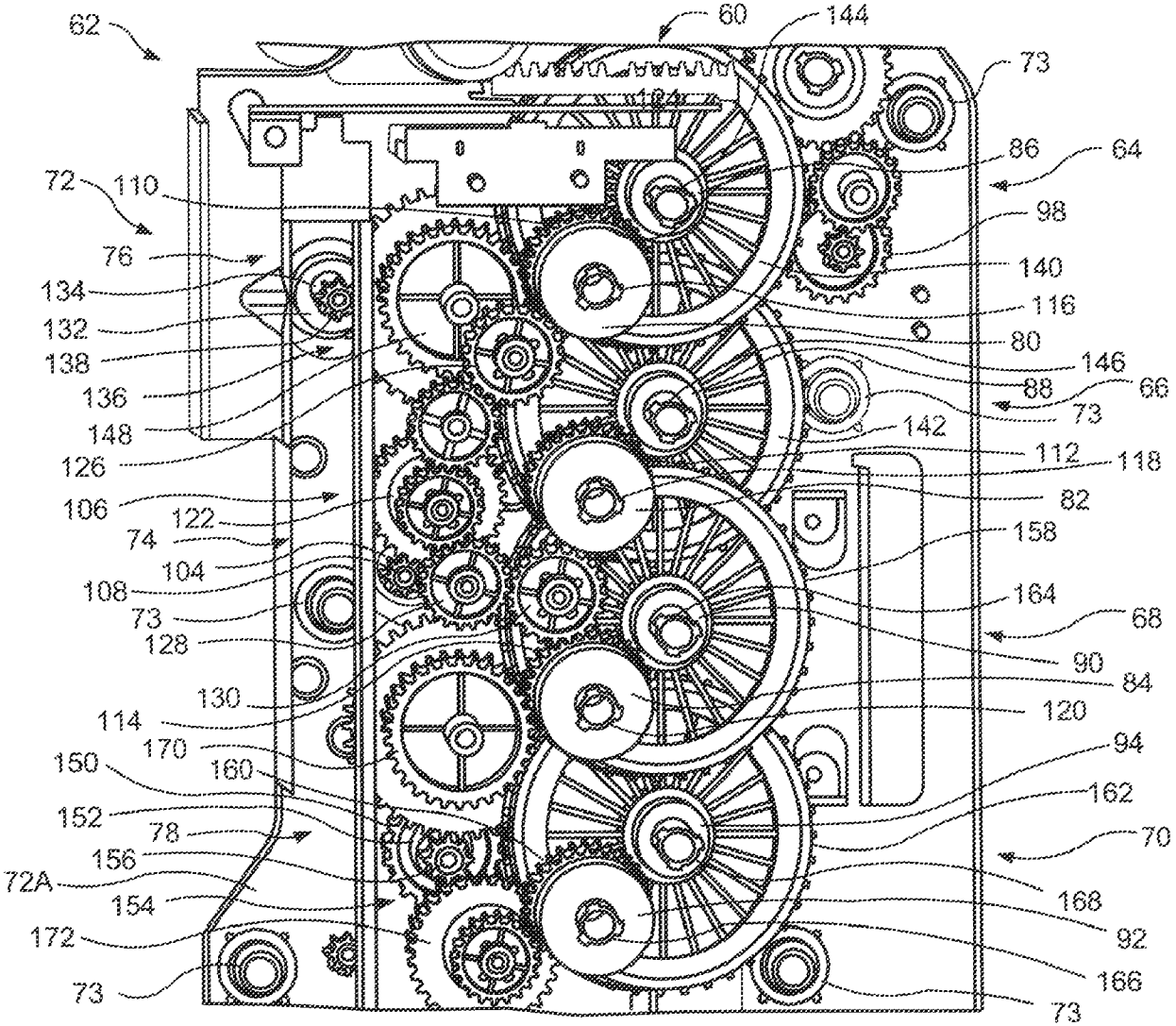

FIG. 4 is a fragmentary elevational view of the opposite inner side of the frame subassembly of the machine, on a further enlarged scale over that of FIG. 3, with the inner mounting plate of the frame subassembly removed to show supported on the outer mounting plate of the frame subassembly the drive motors and other of the plurality of gears of the multiple motor-and-gear-train configurations of the drive assembly of the present invention as well as gears of components previously identified as shown in FIG. 2.

DETAILED DESCRIPTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numerals refer to like, corresponding, or similar, elements throughout the views.

Referring now to FIG. 1, there is schematically illustrated a prior art color electrophotographic (EP) printing machine 10 having four image forming stations 12, 14, 16, 18 for creating yellow (Y), cyan (C), magenta (M) and black (K) toner images. Each image forming station 12, 14, 16, 18 includes a laser printhead 20, a toner supply 22, a developer 23 and a photoconductive (PC) drum 24. A uniform charge is provided on each PC drum 24, which is selectively dissipated by a scanning laser beam generated by a corresponding printhead 20, such that a latent image is formed on the PC drum 24. The latent image is then developed during an image development process via a corresponding toner supply 22 and developer 23, in which electrically charged toner particles adhere to the discharged areas on the PC drum 24 to form a toned image thereon. An electrically biased transfer roller 26 opposes each PC drum 24. An intermediate transfer member (ITM) belt 28 travels in an endless loop and passes through a nip defined between each PC drum 24 and a corresponding one of the transfer rollers 26. The toner image developed on each PC drum 24 is transferred during a first transfer operation to the ITM belt 28, forming a composite toner image thereon. The four PC drums 24 and corresponding transfer roller 26 constitute first image transfer stations 32.

At a second image transfer station 34, the composite toner image, i.e., the yellow (Y), cyan (C), magenta (M) and black (K) toner images combined, is transferred from the ITM belt 28 to a substrate 36. The second image transfer station 34 includes a backup roller 38, on the inside of the ITM belt 28, and a transfer roller 40, positioned opposite the backup roller 38 and on the opposite or outside of the ITM belt 28. Substrates 36, such as paper, cardstock, labels, envelopes or transparencies, are fed from a substrate supply 42 to the second image transfer station 34 so as to be in registration with the composite toner image on the ITM belt 28. Structure for conveying substrates from the supply 42 to the second image transfer station 34 may comprise a pick mechanism 44 that draws a top sheet from the supply 42 and a speed compensation assembly 46. The composite image is then transferred from the ITM belt 28 to the substrate 36. Thereafter, the toned substrate 36 passes through a fuser assembly 48, where the toner image is fused to the substrate 36. The substrate 36 including the fused toner image continues along a paper path 50 until it exits the printing machine 10 into an exit tray 52.

In certain prior art EP printing machines, their gear trains have been configured to drive the developer drive assemblies and PC drum off of the same motor. This often leads to the motor gear mesh frequency being offensive from the standpoint of vibration, or jitter, and noise. If developer torque and drum torque go through the same gear mesh frequency, the noise level and potential for jitter are higher. This occurs most at the motor gear mesh frequency as it is generally at the highest frequency and most offensive to the human ear in the A weighting scale of noise.

Referring now to FIGS. 2-4, there is illustrated a drive system 60 of an EP printing machine 62 that incorporates the features of the present invention. The machine 62 overall has the same basic combination of functional components making up four image forming stations 64, 66, 68, 70 of the machine 62 as are described above with reference to the prior art machine 10 of FIG. 1. It should be noted that, though inconsequential to the applicability of the present invention, the four image forming stations 12, 14, 16, 18 in the prior art machine 10 are arranged in a horizontal orientation, whereas the four comparable image forming stations 64, 66, 68, 70 in the machine 62 are arranged in a vertical orientation. Before entering into a detailed description of the drive system 60 it should further be noted that hereinafter, when referring to a photoconductive drum, the label "PC" will be considered as understood and thus will not be used; instead, the labels, Y, C and M, will be used to designate the respective drum drive assemblies associated with the yellow, cyan and magenta color toner images and the label K will be used to designate the drum drive assembly associated with the black toner image. The same labels will be used to designate the respective colors of the developer drive assemblies.

The drive system 60 of the EP printing machine 62 basically includes a frame, which takes the form of a frame subassembly 72, and multiple (and more particularly, three), first, second and third, motor-and-gear-train configurations, generally designated 74, 76, 78. As seen in FIGS. 2 and 3, the frame subassembly 72 has an outer mounting plate 72A and an inner mounting plate 72B interconnected to one another in a spaced apart relationship by a plurality of connectors 73. However, the inner mounting plate 72B is removed in FIG. 4 so as to expose the various motors and gears of the three configurations 74, 76, 78, which will be identified hereinafter, that are covered by the inner mounting plate 72B in FIG. 3 and thus normally enclosed out of sight between the outer and inner mounting plates 72A, 72B when the frame subassembly 72 is viewed from its inner side as in FIG. 3. It will be noted that the motors and mounted ends of the drum gears and fuse motor can be seen when the frame subassembly 72 is viewed from its outer side as in FIG. 2. The color EP printing machine 62 has the normal conventional plurality of functional components: Y, C and M color developer drive assembly, Y, C and M color drum drive assembly, a K developer drive assembly and a K drum drive assembly, the ends of which can mostly be seen in FIGS. 3 and 4 and are designated respectively by reference numerals 80, 82, 84 for Y, C, M color developer drive assembly, 86, 88, 90 for Y, C and M color drum drive assembly, 92 for K developer drive assembly and 94 for K drum drive assembly. The first, second and third motor-and-gear-train drive configurations 74, 76, 78 of the drive system 60 for driving these components and which constitute the present invention are mounted adjacent to one another on the outer mounting plate 72A of the frame subassembly 72, along with a plurality of additional motors 96, 98, 100 for operating the fuser, belt transport and retraction functional components (not shown in FIGS. 2-4) of the printing machine 62. By these additional motors 96, 98, 100 being mounted adjacent to one another and adjacent to the first, second and third motor-and-gear-train drive configurations 74, 76, 78 on the same outer mounting plate 72A of the frame subassembly 72, they are located outside of where the replaceable (consumable) components, the toner cartridge, developer drive assembly, drum drive assembly, fuser motor and belts are located such that the cost of maintenance as well as the cost to run wire harnesses and add thermal cooling duct during installation become less when all are in one location.

Referring to FIGS. 2 and 4, the first motor-and-gear-train configuration 74 includes a first drive motor 102, operatively mounted to the outer mounting plate 72A of the frame subassembly 72 and having a rotary output drive shaft 104, and a first gear train 106 drivingly coupling the drive shaft 104 of the first drive motor 102 to a first combination of the color developer gears so as to operate them by supplying rotational motion at a preset rpm level to turn them. The first combination specifically includes all color developer drive assemblies, the Y, C and M color developer drive assemblies 80, 82 and 84, which are the yellow, cyan and magenta color developer drive assemblies. The first gear train 106 includes a plurality of intermeshing gears of which one gear 108 is attached to the rotary output shaft 104 of the first drive motor 102 and other gears 110, 112, 114 are respectively attached to the rotary drive couplings 116, 118, 120 of the Y, C, M color developer drive assemblies 80, 82, 84. The first gear train 106 further includes one double-level idler gear 122 rotatably mounted on the inner mounting plate 72B and four other idler gears 124, 126, 128, 130 are interposed between and transfer rotary driving motion from the gear 108 on the output shaft 104 of the first drive motor 102 to the gears 110, 112, 114 on the drive couplings 116, 118, 120 of the color developer drive assemblies 80, 82, 84. The double-level idler gear 122 is also rotably mounted on the outer mounted plate 72A. The four idler gears, 124, 126, 128, 130, are also rotatably mounted by a common mounting plate 131 at the inner side of the inner mounting plate 72B, as seen in FIG. 3. More specifically, the double-level idler gear 122 is interposed between and meshes with gear 108 on output shaft 104 and with idler gear 124, next idler gear 124 also meshes with idler gear 126, and finally idler gear 126 also meshes with gear 110 on drive coupling 116 of Y color developer drive assembly 80. Also, the double-level idler gear 122 is interposed between and meshes with gear 108 on output shaft 104 and with idler gear 128, next idler gear 128 also meshes with idler gear 130, and finally idler gear 130 also meshes with the two gears 112, 114 respectively on drive couplings 118, 120 of C, M color developer drive assemblies 82, 84.

The second motor-and-gear-train configuration 76 includes a second drive motor 132, operatively mounted to the outer mounting plate 72A of the frame subassembly 72 and having a rotary output drive shaft 134, and a second gear train 136 drivingly coupling the drive shaft 134 of the second drive motor 132 to a second combination of the color drum drives so as to operate them by supplying rotational motion at a preset rpm level to turn them. The second combination specifically includes two of the three color drum drives, the Y, C color drum drive assemblies 86, 88, which are the yellow and cyan photoconductive drum drive assemblies. The second gear train 136 includes a plurality of intermeshing gears of which one gear 138 is attached to the rotary output shaft 134 of the second drive motor 132 and other gears 140, 142 and 148 are respectively attached to the rotary drive couplings 144, 146 of Y, C drum drive assemblies 86, 88. The second gear train 136 further includes a double-level idler gear 148 rotatably mounted on the outer mounting plate 72 B and interposed between, meshed with, and thus transferring rotary driving motion from the gear 138 on the output shaft 134 of the second drive motor 132 to the gears 140, 142 and 148 on the drive couplings 144, 146 of the two color drum drive assemblies 86, 88.

The third motor-and-gear-train configuration 78 includes a third drive motor 150, operatively mounted to the outer mounting plate 72A of the frame subassembly 72 and having a rotary output drive shaft 152, and a third gear train 154 drivingly coupling the drive shaft 152 of the third drive motor 150 to a third combination, namely, the one M color drum drive assembly 90 with K developer drive assembly 92 and K drum drive assembly 94 so as to operate them by supplying rotational motion at a present rpm level to turn them. Thus, the third combination specifically includes only the magenta color photoconductive drum drive assembly 90 with the black developer drive assembly 92 and black drum drive assembly 94. The third gear train 154 includes a plurality of intermeshing gears of which one gear is attached to the rotary output shaft 152 of the third drive motor 150 and other gears 158, 160, 162 are respectively attached to rotary drive couplings 164, 166, 168 of the M drum drive assembly 90, the K developer drive assembly 92 and the K drum drive assembly 94. The third gear train 154 further includes a pair of double-level idler gears 170, 172 rotatably mounted to the outer mounting plate 72A and respectively interposed between, meshed with and thus transferring rotary driving motion from the one gear 156 on the output shaft 152 of the third drive motor 150 to the gear 158 on the drive coupling 164 of the M drum drive assembly 90 and to the gears 160, 162 on the drive couplings 166, 168 of the K developer drive assembly 92 and K drum drive assembly 94.

Thus, as mentioned previously, the first, second and third motor-and-gear-train configurations 74, 76, 78 of the drive system 60 supply rotary drive motion to turn the Y, C and M color developer drive assemblies 80, 82, 84 separate from the rotary drive motion supplied to turn the Y, C and M color drum drive assemblies 86, 88, 90 in view that each of the configurations 74, 76, 78 has its own drive motor 102, 132, 150. The drive system 60 of the present invention furthermore separates the rotary drive motion supplied to turn the color developer drive assemblies 80, 82, 84 from that supplied to turn the color drum drive assemblies 86, 88, 90 of the machine 62 in such a way the jitter and noise are reduced to a substantially lower level. This is because the first motor-and-gear-train configuration/Y, C & M color developer motor gear mesh and second motor-and-gear-train configuration/Y & C color drum motor gear mesh are preset to operate at different frequencies. For example, without being limited thereto, the second motor-and-gear-train configuration/Y & C color drum motor gear mesh frequency (as well as the third motor-and-gear-train configuration/M drum and K developer and K drum motor gear mesh (frequency) are preset to operate at about 498 hz, whereas the first motor-and-gear-train configuration/Y, C & M color developer motor gear mesh frequency is preset to operate at about 451 hz. Changing the preset motor gear mesh frequency is brought about by changing either the number of teeth on a gear or the rotational speed of the motor driving the gear. By presetting gear mesh frequencies different for the first and second motor-and-gear-train configurations the frequencies are then not mutually reinforcing and additive and instead function to spread the sound energy over a larger area of the machine 62 thereby reducing overall noise peaks. This brought about a significant reduction of overall noise from 57 dbA for a prior art two-motor system machine to 53 dbA for an EP printing machine in which the drive system 60 of the present invention was implemented.

To summarize, as described above, the drive system 60 of the present invention has abandoned the two-motor approach of a prior art drive system which had elevated jitter and noise due to the two motors of the system which concurrently operated the developer drive assemblies and drum drive assemblies also operate at substantially the same motor gear mesh frequency. In its place, the drive system 60 of the present invention has adopted a three-motor approach which operates with significantly lower jitter and noise due to at least two of three motors operating at different gear mesh frequencies and with more cost-effectiveness by being setup to operate, that is, to drive or turn, one or the other but not both of the color developer drive assemblies and color drum drive assemblies This leads to the ability to shut off the drive motor to the color developer drive assemblies when operating in the black only mode. If the color developer drive assemblies were to continue to operate and turn during black only developer operation, this churning of the color developers drive assemblies decreases their useful life as they rotate but are not being used. These innovations lead to higher print quality as well as a quieter machine compared to prior art two-motor color machines.

Additional cost savings are realized in terms of wire harnessing, thermal ducting, field replaceable subsystems and gear layouts. The drive system 60 is a cost effective maintenance solution to replacing worn out parts. The cartridges, developers, fuser and belt transport can all be replaced without replacing expensive motors. All motors are located on one frame subassembly or at a common location, which will last the life of the machine. The drum drive assemblies, developer drive assemblies, belt transport and fuser all have a life span less than the machine. With the drive motors for developer drive assemblies and drum drive assemblies, fuser, belt transport and retraction located together on the frame subassembly away from and outside of the location of the replaceable (consumable) components, the cost of maintenance as well as the cost to run wire harnesses and add thermal cooling duct are reduced.

The foregoing description of several embodiments of the invention has been presented for purposes of illustration. It is not intended to be exhaustive or to limit the invention to the precise forms disclosed, and obviously many modifications and variations are possible in light of the above teaching. It is intended that the scope of the invention be defined by the claims appended hereto.

What is claimed is:

1. In an electrophotographic printing machine having multiple developer drive assemblies and photoconductive drum drive assemblies, a drive system comprising:

a frame;

a first motor-and-gear-train configuration mounted on said frame and operable at a first motor gear mesh frequency and drivingly coupled to a first combination of said developer drive assemblies and/or photoconductive drum drive assemblies so as to operate said first combination thereof;

a second motor-and-gear-train configuration mounted on said frame and operable at a second motor gear mesh frequency different from said first motor gear mesh frequency and drivingly coupled to a second combination of said developer drive assemblies and/or photoconductive drum drive assemblies so as to operate said second combination thereof; and a third motor-and-gear-train configuration mounted on said frame and drivingly coupled to a third combination of said developer drive assemblies and/or photoconductive drum drive assemblies so as to operate said third combination thereof.

2. The printing machine of claim 1 wherein said frame is a frame subassembly such that said first, second and third motor-and-gear-train configurations are mounted adjacent to one another on said frame subassembly.

3. The printing machine of claim 2 further comprising:

a plurality of additional motors for operating other functional components of said printing machine, said additional motors being mounted on said frame subassembly adjacent to one another and to said first, second and third motor-and-gear-train configurations.

4. The printing machine of claim 1 wherein each of said first, second and third motor-and-gear-train configurations includes a drive motor having a rotary output drive coupling.

5. The printing machine of claim 4 wherein each of said first, second and third motor-and-gear-train configurations also includes a plurality of intermeshing gears of which one of said gears is attached to said rotary output shaft of each of said drive motors and other of said gears are each attached to a rotary drive coupling of a respective one of said developer drive assemblies and/or photoconductive drum drive assemblies.

6. The printing machine of claim 5 wherein each of two of said first, second and third motor-and-gear-train configurations further includes at least one idler gear interposed between said one and other gears.

7. A drive system in a color electrophotographic printing machine having multiple color developer drive assemblies, multiple color photoconductive drum drive assemblies, a black developer and a black photoconductive drum drive assembly, comprising:

a frame;

a first motor-and-gear-train configuration mounted on said frame and drivingly coupled to a first combination of said multiple color developer drive assemblies, said first combination thereof;

a second motor-and-gear-train configuration mounted on said frame and drivingly coupled to a second combination of said multiple color photoconductive drum drive assemblies so as to operate said second combination thereof; and a third motor-and-gear-train configuration mounted on said frame and drivingly coupled to a third combination of one of said multiple color photoconductive drum drive assemblies with said black developer and said black photoconductive drum drive assemblies so as to operate said third combination thereof.

8. The printing machine of claim 7 wherein said frame is a frame subassembly such that said first, second and third motor-and-gear-train configurations are mounted adjacent to one another on said frame subassembly.

9. The printing machine of claim 8 further comprising:

a plurality of additional motors for operating other functional components of said printing machine, said additional motors being mounted on said frame subassembly adjacent to one another and to said first, second and third motor-and-gear-train configurations.

10. The printing machine of claim 7 wherein each of said first, second and third motor-and-gear-train configurations includes a drive motor having a rotary output drive coupling.

11. The printing machine of claim 10 wherein each of said first, second and third motor-and-gear-train configurations also includes a plurality of intermeshing gears of which one of said gears is attached to said rotary output drive coupling of each of said drive motors and other of said gears are each attached to a rotary drive coupling of a respective one of said developers and photoconductive drums.

12. The printing machine of claim 11 wherein each of at least two of said first, second and third motor-and-gear-train configurations further includes at least one idler gear interposed between said one and other gears.

13. The printing machine of claim 7 wherein said first combination includes only yellow, cyan and magenta color developer drive assemblies.

14. The printing machine of claim 7 wherein said second combination includes only yellow and cyan photoconductive drum drive assemblies.

15. The printing machine of claim 7 wherein said third combination includes only a magenta color photoconductive drum with said black developer drive assemblies and black photoconductive drum drive assemblies.

16. In a color electrophotographic printing machine having multiple color developer drive assemblies, multiple color photoconductive drum drive assemblies, a black developer and a black photoconductive drum drive assemblies, a drive system comprising:

a frame;

a first motor-and-gear-train configuration mounted on said frame and operable at a first motor gear mesh frequency and drivingly coupled to a first combination of said multiple color developer drive assemblies to operate said first combination thereof;

a second motor-and-gear-train configuration mounted on said frame and operable at a second motor gear mesh frequency different from said first motor gear mesh frequency and drivingly coupled to a second combination of said multiple color photoconductive drum drive assemblies to operate said second combination thereof; and a third motor-and-gear-train configuration mounted on said frame and drivingly coupled to a third combination of one of said multiple color photoconductive drum drive assemblies with said black developer and said black photoconductive drum drive assemblies to operate said third combination thereof.

17. The printing machine of claim 16 wherein each of said first, second and third motor- and-gear-train configurations includes a drive motor having a rotary output drive coupling.

18. The printing machine of claim 17 wherein each of said first, second and third motor-and-gear-train configurations also includes a plurality of intermeshing gears of which one of said gears is attached to said rotary output drive coupling of each of said drive motors and other of said gears are each attached to a rotary drive coupling of a respective one of said developer drive assemblies and photoconductive drum drive assemblies.

19. The printing machine of claim 18 wherein each of at least two of said first, second and third motor-and-gear-train configurations further includes at least one idler gear interposed between said one and other gears.

20. The printing machine of claim 16 wherein:

said first combination includes yellow, cyan and magenta color developer drive assemblies;

said second combination includes yellow and cyan photoconductive drum drive assemblies; and said third combination includes a magenta color photoconductive drum drive assembly with said black developer assemblies and black photoconductive drum drive assemblies.

* * * * *